US007203327B2

(12) United States Patent
Kubota

(10) Patent No.: US 7,203,327 B2
(45) Date of Patent: Apr. 10, 2007

(54) APPARATUS FOR AND METHOD OF PROCESSING AUDIO SIGNAL

(75) Inventor: Kazunobu Kubota, Saitama (JP)

(73) Assignee: Sony Corporation (JP)

( * ) Notice: Subject to any disclaimer, the term of this patent is extended or adjusted under 35 U.S.C. 154(b) by 611 days.

(21) Appl. No.: 09/920,133

(22) Filed: Aug. 1, 2001

(65) Prior Publication Data

US 2002/0034307 A1 Mar. 21, 2002

(30) Foreign Application Priority Data

Aug. 3, 2000 (JP) ..... P2000-235926

(51) Int. Cl.
*H04R 5/04* (2006.01)

(52) U.S. Cl. ..... 381/310; 381/74

(58) Field of Classification Search ..... 381/17, 381/303, 305, 309, 310, 119, 74
See application file for complete search history.

(56) References Cited

U.S. PATENT DOCUMENTS 4,731,848 A 3/1988 Kendall et al.
5,438,623 A * 8/1995 Begault ..... 381/310
5,585,587 A 12/1996 Inoue et al.
5,796,843 A * 8/1998 Inanaga ..... 381/17
5,987,142 A * 11/1999 Courneau et al. ..... 381/310
6,021,206 A * 2/2000 McGrath ..... 381/310

FOREIGN PATENT DOCUMENTS

EP 0563929 10/1993
WO WO 9916049 A1 * 4/1999

* cited by examiner

*Primary Examiner*—Daniel Swerdlow
(74) *Attorney, Agent, or Firm*—Lerner, David, Littenberg, Krumholz & Mentlik, LLP

(57) ABSTRACT

A number (M) of sound source signals T1, T2, T3, T4, each having at least one information element of position information, movement information and localization information, are synthesized to N sound source signals SL, SR based on the information element where N is smaller than the number (M) of the sound source signals and the N synthesized sound source signals SL, SR having this synthesized information are localized in a virtual sound image. An amount of data to be processed can be reduced while virtual reality can be realized by the synthesized sound source signals.

18 Claims, 6 Drawing Sheets

APPARATUS FOR AND METHOD OF PROCESSING AUDIO SIGNAL

BACKGROUND OF THE INVENTION

1. Field of the Invention

The present invention relates to apparatus for and method of processing audio signal for use with video game machines, personal computers and the like and in which a sound image of a sound source signal is localized virtually.

2. Description of the Related Art

In general, when virtual reality is realized by sounds, there is known a method in which a monaural audio signal is processed by suitable signal processing such as filtering, so that a sound image can be localized not only between two speakers but also at any positions of a three-dimensional space for a listener by using only two speakers.

When a monaural audio signal is processed by proper filtering based on transfer functions (HRTF: Head Related Transfer Function) from a position at which a sound image of an inputted monaural audio signal is localized to listener's ears and transfer functions from a pair of speakers located in front of listener to listener's ears, a sound image can be localized even at any place other than the positions of a pair of speakers such as in the rear of and in the side of listener. In the specification of the present invention, this technique will be referred to as a "virtual sound image localization". Reproducing devices maybe speakers, headphones or earphones worn by a listener. When through headphones a listener listens to reproduced sounds of audio signal which has not been processed by this signal processing, there occurred a so-called "in-head localization" of reproduced sound image. If the above processing is effected on the audio signal, then a reproduced sound image can provide "out-head localization" similar to the sound image localization obtained by the speakers. Moreover, it becomes possible to localize a sound image at an arbitrary position around the listener similarly to the virtual sound image localization done by the speakers. Although contents of signal processing become slightly different in response to respective reproducing devices, resulting outputs become a pair of audio signals (stereo audio signals). Then, when the above audio signals, i.e., stereo audio signals are reproduced by a pair of appropriate transducers (speakers or headphones), a sound image can be localized at an arbitrary position. Of course, inputted signals are not limited to the monaural audio signal. As will be described later on, a plurality of sound source signals are filtered in accordance with respective localization positions and can be added together so that a sound image can be localized at an arbitrary position.

Furthermore, when multi-channel speakers are located around the listener and sound source signals are properly assigned to these channels, desired sound images can be localized.

On the other hand, there is known a method in which images and sound images can be localized by using the above technique as the user is operating the reproducing device.

In accordance with enhancement of throughput of recent processors and in accordance with a producer's demand and seeking for reproducing more complex and realer virtual reality, processing itself becomes advanced and more complex increasingly.

Since the sound virtual localization method which becomes the above fundamental technology assumes an original monaural sound signal as a point sound source, when the producer intends to express a sound source of large size which cannot be reproduced by a point sound source in order to localize a sound source near a set of sound sources with complex arrangement and a listener, a set of sound sources are divided and held as a plurality of point sound sources T1, T2, T3, T4 beforehand and a plurality of point sound sources are virtually localized separately. Then, as shown in FIG. 1, a sound signal is produced by effecting synthesizing processing such as mixing on these point sound sources.

Let us assume a set of sound sources comprised of four point sound sources T1, T2, T3, T4 as shown in FIG. 2, for example. When the position of this set is moved or rotated, virtual sound images of all point sound sources T1, T2, T3, T4 are localized and sound images are localized for a listener M at the positions shown by T11, T21, T31, T41.

When position relationships of the respective sound sources comprising this set are transformed, virtual sound images of all point sound sources T1, T2, T3, T4 are similarly localized, whereby sound images are localized for the listener M at positions shown by T12, T22, T32, T42 in FIG. 2.

However, according to the above method, when virtual sound image localization of a realized sound source object (sound source having position information and the like) becomes more complex and the number of the point sound sources increases, an amount of signals to be processed becomes huge to oppress other processing, otherwise an amount of signals to be processed exceeds an allowable signal processing amount so that the audio signal processing apparatus becomes unable to reproduce an audio signal.

SUMMARY OF THE INVENTION

In view of the aforesaid aspect, it is an object of the present invention to provide apparatus for and method of processing an audio signal in which an amount of signal to be processed can be reduced while virtual reality of sounds can be realized.

According to an aspect of the present invention, there is provided a method of processing an audio signal which is comprised of the steps of synthesizing a plurality of (M) sound source signals to provide N sound source signals, the number N being smaller than the number M of the sound source signals, based on at least one of position information, movement information and localization information of the M sound sources, synthesizing at least one information of position information, movement information and localization information which are corresponding to the synthesized sound source signals and localizing the N synthesized signal sound source signals in sound image based on the synthesized information.

According to the present invention, since the synthesized sound signals are synthesized from the sound source signals and virtual sound images of the synthesized sound source signals of the number smaller than that of the original sound source signals are localized, the amount of signals to be processed can be reduced.

According to other aspect of the present invention, there is provided a method of processing an audio signal which is comprised of the steps of synthesizing N sound source signals from a plurality of (M) sound source signals where N is smaller than M, localizing the N synthesized sound source signals in virtual sound image based on a plurality of previously-determined localization positions, storing a plurality of reproducing audio signals, localized in virtual sound image, in memory means and reading and reproducing the reproducing audio signal from the memory means in response to reproducing localization positions of the synthesized sound source signals.

In accordance with a further aspect of the present invention, there is provided an apparatus for processing an audio signal which is comprised of synthesized sound source signal generating means for synthesizing a plurality of (M) sound source signals to provide N sound source signals, the number N being smaller than the number M of the sound source signals, based on at least one of position information, movement information and localization information of the sound sources, synthesized information generating means for generating synthesized information by synthesizing information corresponding to the synthesized sound source signal from the information and signal processing means for localizing the N synthesized sound source signals in sound image based on the synthesized information.

According to the present invention, since virtual sound images of the synthesized sound source signals whose number is smaller than that of the original sound source signals are localized, the amount of signals to be processed can be reduced.

In accordance with yet a further aspect of the present invention, there is provided an apparatus for processing an audio signal which is comprised of means for generating a synthesized sound source signal by synthesizing N sound source signals from a plurality of (M) sound source signals where N is smaller than M, signal processing means for providing a plurality of sets of reproduced audio signals by localizing the N synthesized sound source signals in virtual sound image based on a plurality of sets of previously-determined localization positions, memory means or storing a plurality of sets of reproduced audio signals obtained by the signal processing means and reproducing means for reading and reproducing the reproduced audio signal from the memory means in response to reproducing localization position of the synthesized sound source signal.

According to the present invention, since the synthesized sound source signals which had been localized in virtual sound image in advance are stored in the memory means and the synthesized sound source signals are read out from the memory means in response to the reproduced localization positions of the synthesized sound source signals and then reproduced, the amount of signals to be processed can be reduced. Further, since the virtual sound images of the synthesized sound source signals are localized in advance, the signal processing amount required when they are reproduced also can be reduced.

In accordance with still a further aspect of the present invention, there is provided a recording medium in which there are recorded synthesized sound source signals in which a plurality of (M) sound source signals are synthesized to N signals whose number N is smaller than the number (M) of the sound source signals based on at least one information of position information, movement information and localization information of the sound source and synthesized information synthesized as at least one information of position information, movement information and localization information corresponding to the synthesized sound source signals in association with each other.

According to the present invention, since the synthesized sound source signals whose number is smaller than that of the original sound source signals are generated and stored, a capacity for storing the synthesized sound source signals can be reduced. If the synthesized sound source signals whose virtual sound images had been localized in advance are stored, then the signal processing amount required when the signals are reproduced can be reduced.

DESCRIPTION OF THE PREFERRED EMBODIMENTS

Apparatus for and method of processing an audio signal according to embodiments of the present invention will be described below with reference to the accompanying drawings.

First, a video game machine to which the present invention is applied will be described with reference to FIG. 3.

Figure 1:
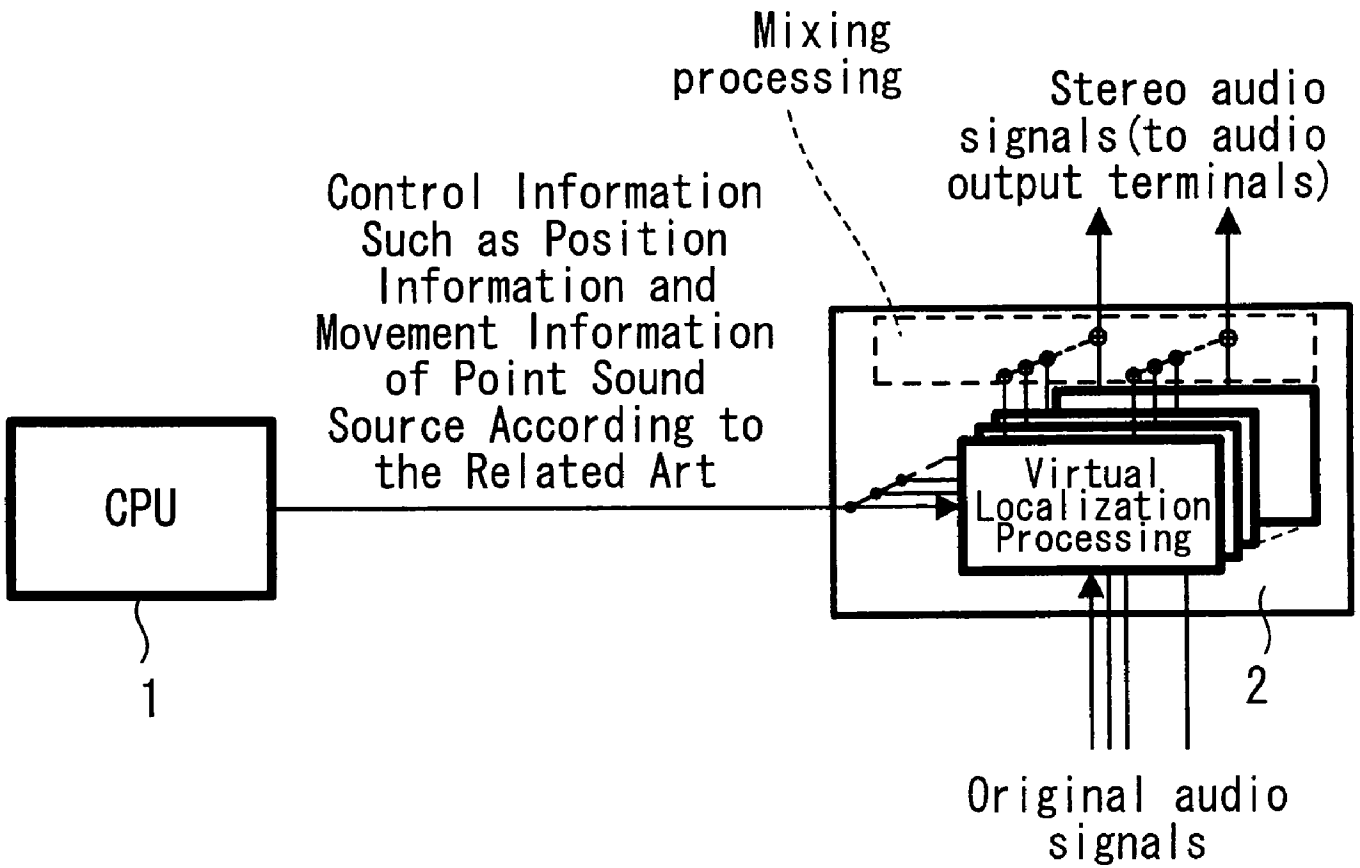
FIG. 1 (RELATED ART)
FIG. 1 is a schematic diagram to which reference will be made in explaining the manner in which virtual sound images of a plurality of point sound sources are localized and mixed according to the related art.
Figure 2:
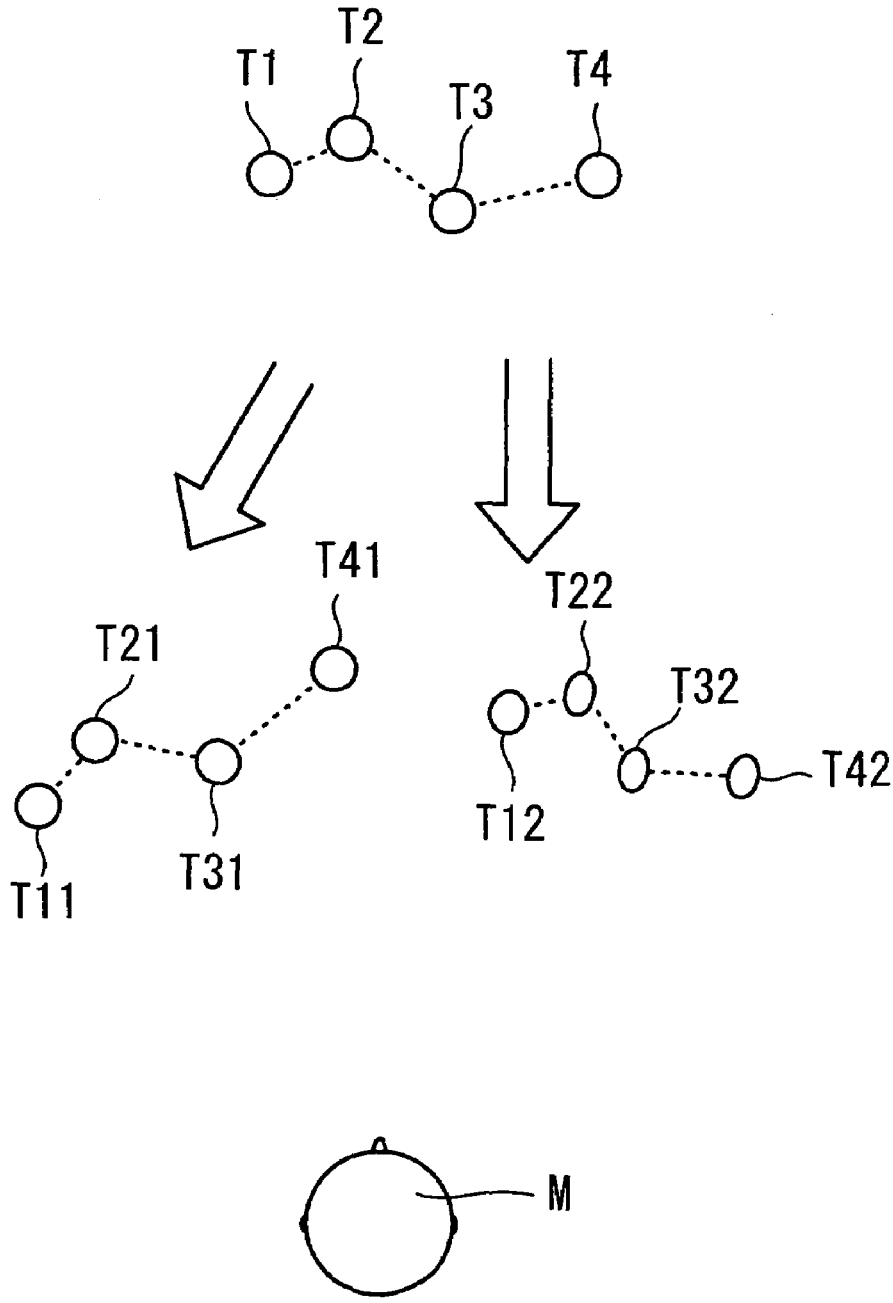
FIG. 2 (RELATED ART)
FIG. 2 is a schematic diagram to which reference will be made in explaining an example of an audio signal processing method according to the related art.
Figure 3:
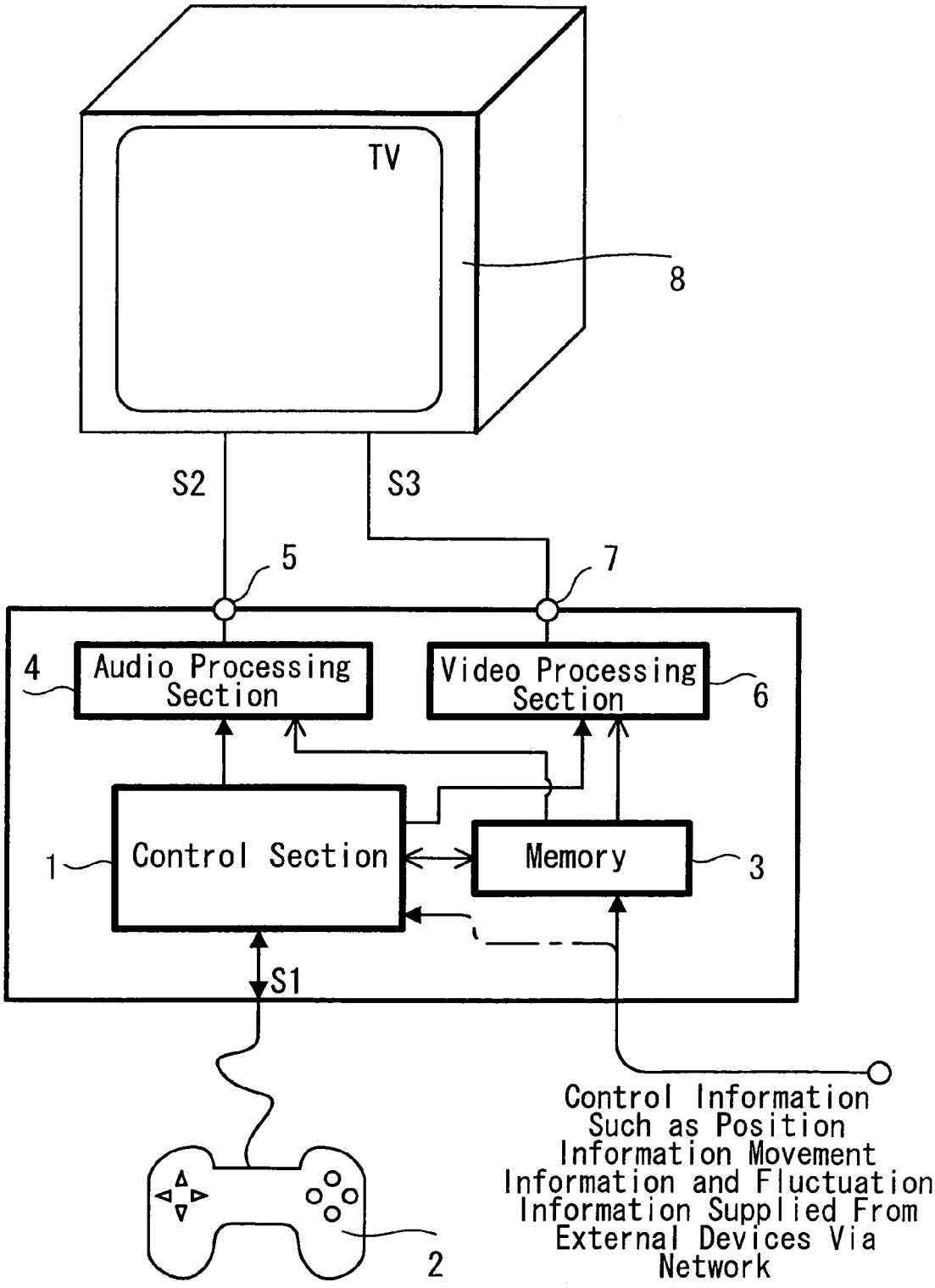
FIG. 3 is a block diagram showing an example of a video game machine.

As shown in FIG. 3, a video game machine includes a central processing unit (CPU) 1 comprised of a microcomputer to control the whole of operations of this video game machine. While a user is operating an external control device (controller) 2 such as a joystick, an external control signal S1 responsive to operations of the controller 2 is inputted to the CPU 1.

The CPU 1 is adapted to read out information for determining positions or movements of a sound source object which generates a sound from a memory 3. Information thus read out from the memory 3 can be used as information for determining the position of a sound source object (point sound source). The memory 3 is comprised of a suitable means such as a ROM (read-only memory), a RAM (random-access memory), a CD-ROM (compact disc read-only memory) and a DVD-ROM (digital versatile disc read-only memory) in which this sound source object and other necessary information such as software game are written. The memory 3 may be attached to (or loaded into) the video game machine.

In the specification of the present invention, the sound source object includes at least one information of a sound source signal, sound source position/movement information and localization position information as its attribute. Although one sound source object can be defined to a plurality of sound sources, in order to understand the present invention more clearly, a sound source object is defined to one sound source and a plurality of sound sources are referred to as "a set of sound sources".

The above sound source position information designates sound source position coordinates in the coordinate space assumed by software game, relative sound source position relative to listener's position, relative sound source position relative to reproduced image and the like. Further, the coordinates may be either orthogonal coordinates system or polar coordinates system (azimuth and distance). Then, movement information refers to the coordinates direction in which localization position of reproducing sound source is moved from the current coordinates and also refers to a velocity at which the localization position of reproducing sound source is being moved. Therefore, the movement information may be expressed as a vector amount (azimuth and velocity). Localization information is information of localization position of a reproducing sound source and may be relative coordinates obtained when seen from a game player (listener). The localization information may be FL (front left), C (center), FR (front right), RL (rear left) and RR (rear right) and may be defined similarly to the above "position information".

Even when the operator does not operate the video game machine, position information and movement information of the sound source object may be associated with time information and event information (trigger signal for activating the video game machine), recorded in this memory 3 and may express movement of a previously-determined sound source. In some cases, in order to represent fluctuations, information which moves randomly may be recorded in the memory 3. The above fluctuations are used to add stage effects such as explosion and collision or to add delicate stage effects. In order to realize random movements, software or hardware which generates random numbers may be installed in the CPU 1 or a table of random numbers and the like may be stored in the memory 3.

While the operator operates the external control device (controller) 2 to supply the external control signal S1 to the CPU 1 in the embodiment shown in FIG. 3, there is known a headphone in which operator's (listener's) head movements (rotation, movement, etc.) are detected by a sensor and sound image localization position is changed in response to detected movements. A detected signal from such sensor may be supplied to the CPU 1 as the external control signal.

In conclusion, the sound source signal in the memory 3 may include position information, movement information and the like beforehand or may not include them. In either cases, the CPU 1 adds position change information supplied in response to instruction from the inside/outside to the sound source signal and determines sound image localization position of this sound source signal. For example, let us now assume that movement information representing an airplane which is flying from front overhead right behind a player during a player is playing a game is recorded on the memory 3 together with the sound source signal. When a player provides instruction for turning the airplane left by operating the controller 2, the sound image localization position is varied in such a manner that sounds of the airplane are generated as if the airplane were leaving in the right-hand side.

This memory 3 need not be placed within the same video game machine and may receive information from a separate machine through the network, for example. Cases are also conceivable in which a separate operator exists for separate video game machine, and sound source position and movement information based on this operation information, as well as fluctuation information and the like generated by the separate video game machine, are included in determination of the position of the sound source object.

Accordingly, in addition to position/movement information that the sound source signal possesses beforehand, the sound source position and the movement information (including localization information) determined by information obtained from the CPU 1 based on position change information supplied in response to instruction from inside/outside are transmitted to the audio processing section 4. The audio processing section 4 effects virtual sound image localization processing on an incoming audio signal based on transmitted sound source position and movement information and outputs finally the audio signal thus processed from an audio output terminal 5 as a stereo audio output signal S2.

When there are a plurality of sound source objects to be reproduced, respective position and movement information for the plurality of sound source objects are determined within the CPU 1. This information is supplied to the audio processing section 4, and the audio processing section 4 localizes virtual sound image of each sound source object. Then, the audio processing section 4 adds (mixes) left-channel audio signal and right-channel audio signal corresponding to the respective sound source objects, separately, and supplies the audio signals generated from all sound source objects to an audio output terminal 5 as stereo output signals.

In cases where there are other audio signals, for which virtual sound image localization is not performed, a method is conceivable in which audio signals are mixed to the above audio signals and outputted at the same time. In this embodiment, no provisions are made with respect to audio signals for which virtual sound image localization is not performed.

Simultaneously, the CPU 1 transmits information to be displayed to a video processing section 6. The video processing section 6 processes the supplied information in a suitable video processing fashion and outputs a resulting video signal S3 from a video output terminal 7.

The audio signal S2 and the video signal S3 are supplied to an audio input terminal and a video input terminal of a monitor 8, for example, whereby a player and a listener can experience virtual reality.

A method of reproducing a complex object according to this embodiment will be described.

When realizing a complex object such as a dinosaur, for example, a voice is generated from the head, sounds such as footsteps come from the feet. If a dinosaur has a tail, still other sounds (e.g., the tail striking the ground), as well as abnormal sounds from the belly, may be generated. In order to further enhance the sense of reality, different other sounds may be generated from various other parts of the dinosaur.

When virtual reality is reproduced by using CG (computer graphics) in the video game machine like this embodiment, there is known a method in which point sound sources are positioned in response to the minimum unit (polygon, etc,) of an image to be drawn, the point sound sources are moved in the same way as movement of the image and the sense of reality can be reproduced by localizing virtual sound images.

In the above example of the dinosaur, voices, footsteps sounds generated from the tail and the like are positioned to correspond to the mouth, feet and tail in the image, virtual sound images are individually localized in accordance with their movements, stereo audio signals obtained from the respective virtual sound image localization are added in the left and right channels separately and are outputted from the audio output terminal 5.

According to this method, the greater the increases in the number of sound source objects (point sound sources which are to be positioned), the more nearly the representation approaches reality, but the greater the increase in processing amount.

Figure 4:
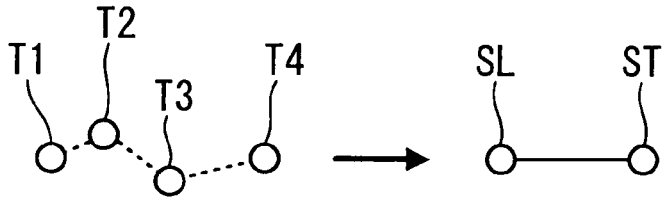
FIG. 4 is a schematic diagram to which reference will be made in explaining an audio signal processing method according to an embodiment of the present invention.

Paying attention to peculiarity of the image in understanding position of sound, as shown in FIG. 4, the sound source objects T1, T2, T3, T4 are synthesized and processed and stored as stereo audio signals SL, SR. In this case, synthesized information is formed by synthesizing position and movement information of the stereo audio sources SL, SR of this synthesized sound source.

In general, understanding of position by the sense of hearing is vague as compared with understanding of position by the sense of sight. Even if sound source objects are not positioned in accordance with the aforementioned minimum drawing unit, position can be understood and space can be recognized. That is, sound sources need not be classified with unit as small as that required by image processing.

According to the conventional stereo reproduction technique, when sounds are reproduced by two speakers, the listener M cannot always hear sounds generated from these speakers as if all sounds are placed at the positions at which those speakers are placed. Accordingly, the listener can hear sounds as if sounds were placed on a line connecting the two speakers.

In accordance with the progress of recording and editing technologies in recent years, it becomes possible to reproduce sounds with a sense of depth on the above line of the two speakers.

With the above background, a plurality of sound source objects T1, T2, T3, T4 are synthesized as shown in FIG. 4 and are edited in advance and stored as the stereo audio signals SL, SR. In this case, synthesized information also is formed by synthesizing position and movement information of the stereo audio signals SL, SR of this synthesized sound source. The method of forming this synthesized information is to average and add all of position and movement information contained in synthesized sound source within one group and to select and estimate any of position and movement information, etc. For example, as shown in FIG. 4, position information of the sound source objects T1, T4 are respectively copied as position information of stereo sound sources SL, SR, sound source signals of the sound source objects T1, T4 are respectively assigned to the stereo audio signals SL, SR, a sound source signal of the sound source object T2 is mixed to the stereo audio signals SL, SR with a sound volume ratio of 3:1, a sound source signal of the sound source T3 is similarly mixed to the stereo audio signals SL, SR with a sound volume ratio of 2:3, for example, thereby resulting the synthesized audio signal and the synthesized information being formed. By using the stereo audio signals SL, SR serving as the synthesized sound sources, the two synthesized stereo sound sources SL, SR are properly disposed at most.

Figure 5:
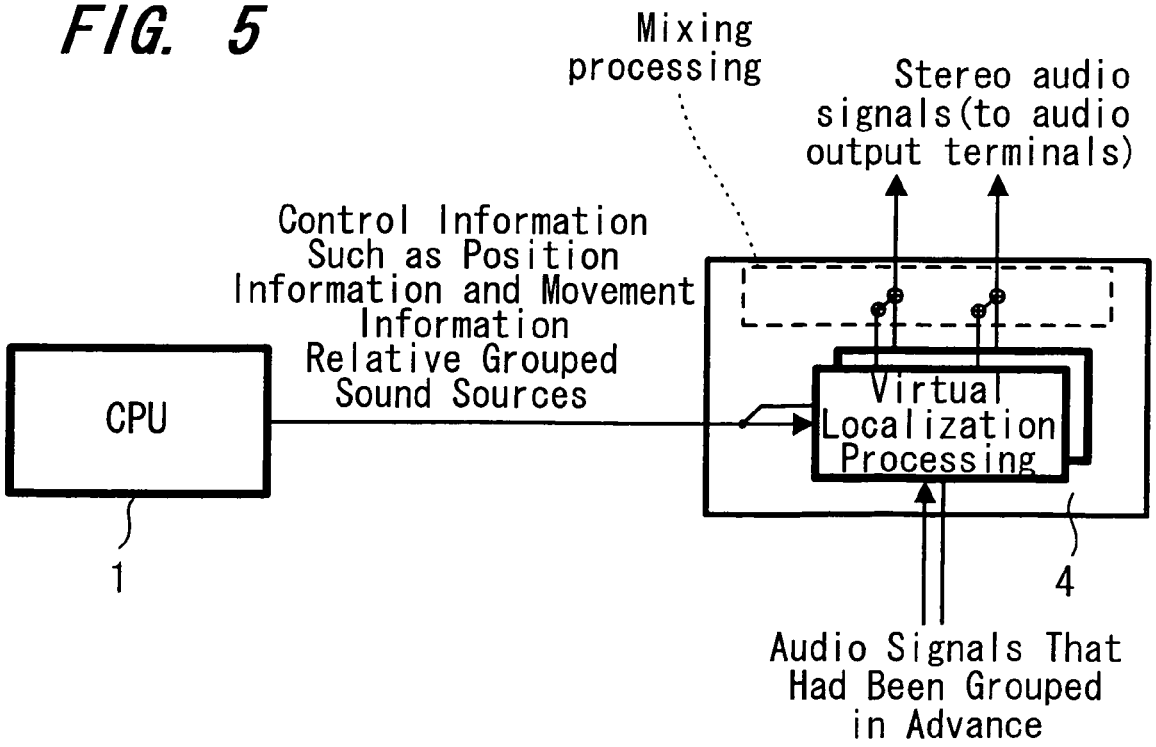
FIG. 5 is a block diagram to which reference will be made in explaining the manner in which two virtual sound images are localized and mixed.

If sounds are accompanied with image, then it is sufficient to place sound sources of the above two points on two proper polygons used in such image. Sound sources need not always be placed in the image, but may be placed independently and processed. The CPU 1 executes control over the two points thus set. The audio processing section 4 localizes virtual sound images of these two synthesized sound source SL, SR based on the above synthesized information and mixes resulting synthesized sound sources to the left and right channel components as shown in FIG. 5. Then, the mixed output signals are outputted to the audio output terminal as stereo audio signals.

Figure 6:
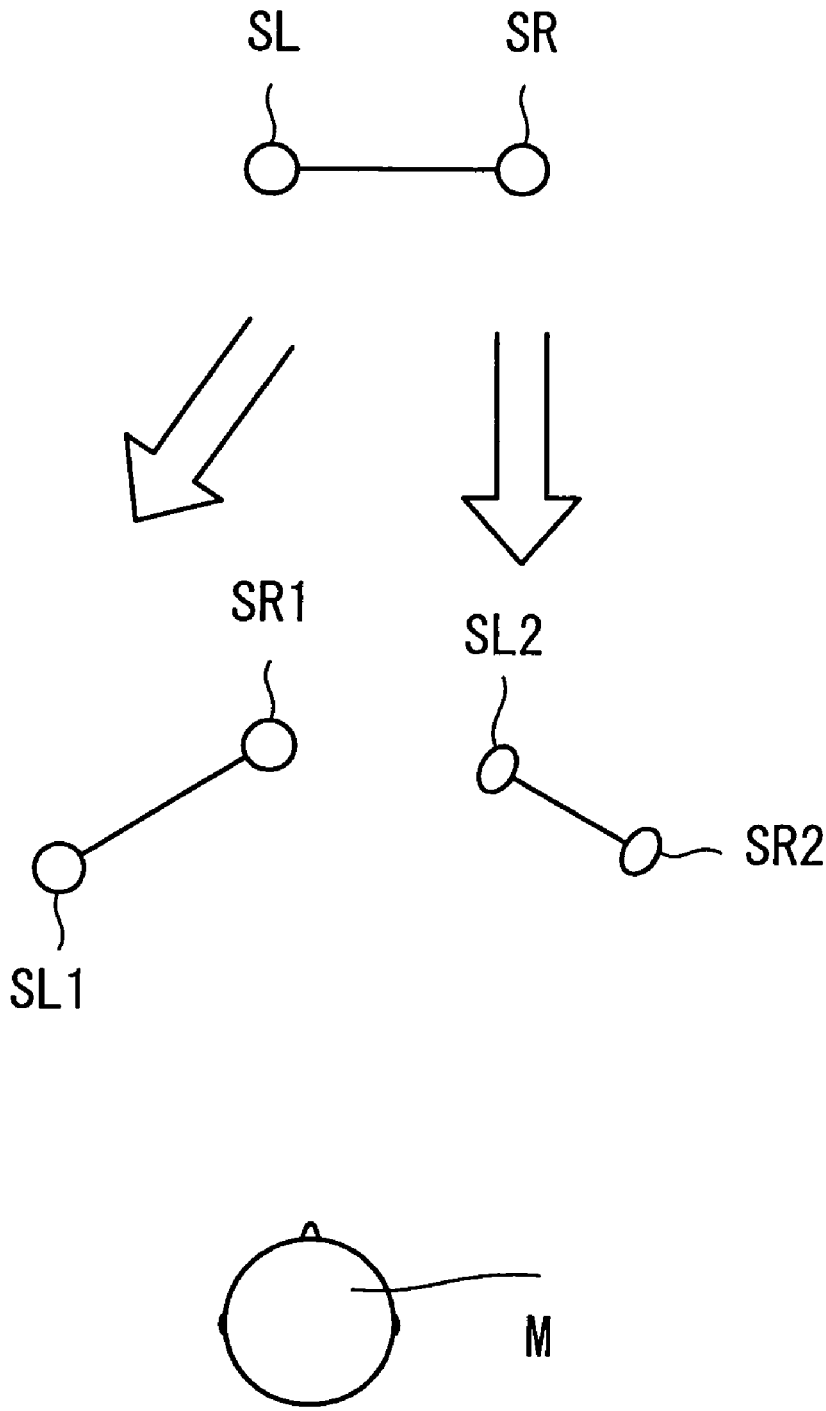
FIG. 6 is a schematic diagram to which reference will be made in explaining the audio signal processing method according to the embodiment of the present invention.

As shown in FIG. 6, for example, when the sound sources are grouped to provide the stereo sound sources SL, SR as synthesized sound sources, if virtual position is moved or rotated, then virtual sound images of the stereo sound sources SL, SR of the two synthesized sound sources are localized in response to synthesized information based on the movement or rotation, so that sound images are localized as the positions shown by the sound sources SL1, SR1, for example, with respect to the listener M.

When a position relationship between respective sound sources comprising this set is transformed, virtual sound images of only stereo sound sources SL, SR of the two synthesized sound sources are localized in response to synthesized information based on such transformation, so that sound images are localized at the positions shown by the sound sources SL2, SR2 in FIG. 6, for example, with respect to the listener M.

As described above, while position and movement information should be controlled and virtual sound images should be localized for the number of sound source objects according to the related art, in this embodiment, at most two position and movement information are transmitted to the audio processing section 4 for the stereo sound sources SL, SR, at most two virtual sound images are localized and added (mixed) for the left and right channels as shown in FIG. 5. As a consequence, an amount of signals to be processed can be reduced.

The sound source object preprocessing (sound source signals are grouped and audio signal is converted into stereo audio signals) is not necessarily performed to incorporate all sound source objects from which sounds are to be generated into stereo audio signals, rather, the producer should execute the above preprocessing after the producer had compared the amount of processed signals required when position and movement information of all sound source objects are controlled and virtual sound images should be localized according to the related art with changes of effects achieved when sound source signals are grouped.

For example, as earlier noted, let us assume that there are two dinosaurs and that all sound source objects are preprocessed into stereo audio signals as one group. Although sounds of the two dinosaurs can be reproduced when the two dinosaurs are always moving side by side, sounds of the two dinosaurs cannot be reproduced when they are moving separately.

On the other hand, when the producer is expecting other effects achieved by grouping sound source objects of the two dinosaurs, it is needless to say that the above sound source objects of the two dinosaurs should be preprocessed into one group.

Even if there is only one dinosaur, their sound sources need not be grouped into one sound source. For example, if the upper half of the body and the lower half of the body of the dinosaur are set to two groups, then different effects of virtual reality may be achieved when sound sources are grouped into one sound source. This alternative may be adopted as well.

Further, grouped sound sources are not always limited to stereo sound sources. If grouped sound sources can be realized as point sound sources as shown in FIGS. 7A to 7C, for example, then grouped sound sources maybe converted into a monaural sound source SO.

Figure 7A:
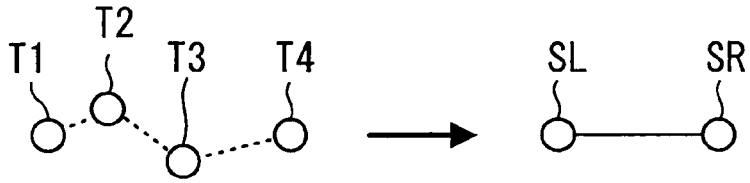
FIGS. 7A to 7C are respectively schematic diagrams to which reference will be made in explaining an audio signal processing method according to another embodiment of the present invention.
Figure 7B:
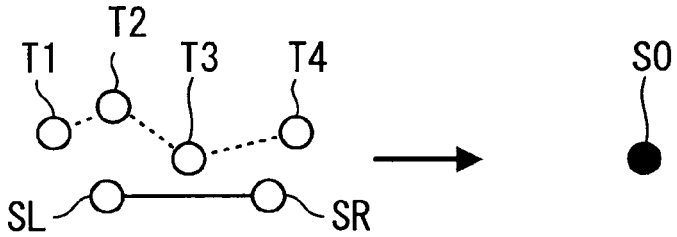
Figure 7C:
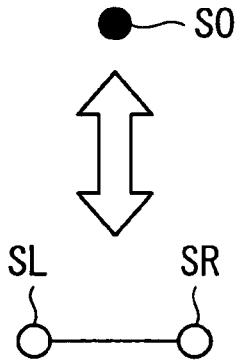
Figure 7C:
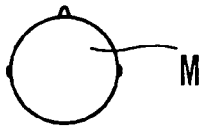

In the example shown in FIGS. 7A to 7C, a plurality of sound source objects T1, T2, T3, T4 are grouped in advance and held as stereo sound source signals SL, SR as synthesized sound source signals as shown in FIG. 7A. Considering a case in which sound images are localized at positions distant from the listener M, sound sources are converted into (further grouped into) a more approximate sound source SO shown in FIG. 7B and held. When a set of sound sources comprising a plurality of sound source objects is located at the position relatively distant from the listener, the respective sound sources can be treated under the condition that they are approximately concentrated at a single point.

In this case, the sound source objects that had been grouped as the stereo audio signals SL, SR are grouped so as to become monaural audio signals and the sound source SO thus held is localized as shown in FIG. 7C, whereby the amounts of position information and movement information of sound sources can be reduced and the amount of virtual sound image localization can be decreased.

According to the embodiment of the present invention, sound source objects, which has been subdivided so far, are grouped into one or two sound sources, preprocessed, processed and stored as audio signals of proper channels for every group. Then, when virtual sound images of the preprocessed audio signals are localized in accordance with reproduction of virtual space, the amount of signals to be processed can be reduced.

While the audio signals are grouped and one or two sound signals are stored as described above, the present invention is not limited thereto and three sound signals or more may be stored if it is intended to reproduce more complex virtual reality as compared with the case in which virtual reality is reproduced by stereo audio signal according to the related-art technique. In this case, although position information and movement information of sound sources should be controlled and virtual sound images should be localized in the number equal to the number of the stored sound source signals, the amount of signals to be processed can be reduced by properly grouping the number N of the grouped sound source signals such that the number N may become smaller than the number M (number of original point sound sources) of the original sound source objects.

While the virtual sound image localization is executed as time elapses as described above, the present invention is not limited thereto and N sound source signals may be synthesized from M (M is plural), e.g., four sound source signals, the number N being smaller than the number M, N, e.g., virtual sound images of two synthesized sound source signals may be localized based on a plurality of previously-determined localization positions, a plurality of sets of synthesized sound source signals that had been localized in virtual sound image may be stored in the memory (storage means) 3 in association with their localization positions and the synthesized sound source signals may be read out from the memory 3 and reproduced in response to the reproduced localized positions of the synthesized sound source signals.

In this case, action and effects similar to those of the above embodiment can be achieved. In addition, since the synthesized sound source signals which had been localized in virtual sound image in advance are stored in the memory 3 and the synthesized sound source signals are read out from the memory 3 in response to the reproduced localization positions of the synthesized sound source signals and reproduced, an amount of signals to be processed upon reproduction also can be reduced.

As described above, the memory 3 may be provided in the form of a memory that can be attached to (loaded into) the video game machine. If the memory 3 is provided in the form of a CD-ROM or a memory card, for example, then the previously-generated synthesized sound source signals may be recorded on the memory 3 in association with their localization information and distributed and the synthesized sound source signals may be read out from the memory 3 by the video game machine.

While the stereo audio signals are obtained by localizing virtual sound images of the synthesized sound source signals as described above, the present invention is not limited thereto and stereo sound signals may be outputted as multi-channel surround signals such as 5.1-channel system signals. Specifically, multi-channel speakers maybe disposed around the listener like the multi-channel system such as 5.1-channel system and sound source signals may be properly assigned to these channels and then outputted. Also in this case, N (N<M) sound source signals may be synthesized by grouping M sound source signals and desired sound images can be localized based on position information corresponding to the synthesized sound source signals and the like.

According to the present invention, the sense of virtual reality can be achieved by sounds while the amount of signals to be processed can be reduced.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A method of processing an audio signal comprising the steps of:

receiving a plurality of M sound source signals, each of said M sound source signals having an attribute including at least one of position information, movement information, and localization position information;

arranging said M sound source signals in N groups so as to form N grouped sound source signals, where N is less than M;

arranging said M attributes in N groups corresponding to each of said N grouped sound source signals so as to form N grouped attributes;

storing the N grouped sound source signals;

providing a control signal having one of position information and movement information;

reading out the stored N grouped sound source signals; and performing virtual localization processing on the readout N grouped sound source signals based on the control signal and the N grouped attributes so as to produce left and right stereo signals.

2. The method of processing an audio signal according to claim 1, wherein said step of performing virtual localization processing is a virtual sound image localization for obtaining the left and right stereo signals supplied to a pair of acoustic transducers to localize a sound image at an arbitrary position around a listener.

3. The method of processing an audio signal according to claim 1, wherein at least one of said attributes of said M sound source signals is changed by a change instruction.

4. The method of processing an audio signal according to claim 3, wherein said change instruction is supplied by a user's operation.

5. The method of processing an audio signal according to claim 3, wherein said change instruction is obtained by detecting a movement of a listener's head.

6. The method of processing an audio signal according to claim 1, further comprising the step of supplying random fluctuations to at least one sound source signal of said M sound source signals and/or said N grouped sound source signals.

7. The method of processing an audio signal according to claim 1, wherein a number of groups of said N grouped sound source signals is two or greater, at least one of said N grouped sound source signals is based on the attribute of localization information.

8. The method of processing an audio signal according to claim 1, further comprising the steps of changing a video signal in response to changes of reproducing localization positions of said M sound source signals or said N grouped sound source signals and outputting said video signals.

9. A method of processing an audio signal comprising the steps of:

receiving a plurality of M sound source signals, each of said M sound source signals having an attribute including at least one of position information, movement information, and localization position information;

arranging said M sound source signals in N groups so as to form N grouped sound source signals, where N is less than M;

arranging said M attributes in N groups corresponding to each of said N grouped sound source signals so as to form N grouped attributes storing the N grouped sound source signals;

providing control information having one of position information and movement information;

reading out the stored N grouped sound source signals; and performing virtual localization processing on the readout N grouped sound source signals based on the control information and the N grouped attributes so as to produce left and right stereo signals.

10. The method of processing an audio signal according to claim 9, wherein at least one of said attributes of said M sound source signals is changed by a change instruction.

11. The method of processing an audio signal according to claim 10, wherein said change instruction is supplied by a user's operation.

12. The method of processing an audio signal according to claim 10, wherein said change instruction is obtained by detecting a movement of a listener's head.

13. The method of processing an audio signal according to claim 9, further comprising the step of supplying random fluctuations to said N grouped sound source signals.

14. The method of processing an audio signal according to claim 9, wherein a number of groups of said N grouped sound source signals is two or larger, at least one of said grouped sound source signals is based on the attribute of localization information.

15. An apparatus for processing an audio signal comprising:

means for receiving a plurality of M sound source signals, each of said sound source signals having an attribute including at least one of position information, movement information, and localization position information;

means for arranging said M sound source signals in N groups so as to form N grouped sound source signals, where N is less than M;

means for arranging said M attributes in N groups corresponding to each of said N grouped sound source signals so as to form N grouped attributes;

a memory for storing the N grouped sound source signal;

means for providing a control signal having one of position information and movement information;

means for reading out from the memory the stored N grouped sound source signals; and a processor for performing virtual localization processing on the read-out N grouped sound source signals based on the control signal and the N grouped attributes so as to produce left and right stereo signals.

16. The apparatus for processing an audio signal according to claim 15, wherein said virtual localization processing in said processor is a virtual sound image localization for obtaining the left and right stereo signals supplied to a pair of acoustic transducers to localize a sound image at an arbitrary position around a listener.

17. An apparatus for processing an audio signal comprising:

means for receiving a plurality of M sound source signals, each of said sound source signals having an attribute including at least one of position information, movement information, and localization position information;

means for arranging said M sound source signals in N groups so as to form grouped sound source signals, where N is less than M;

means for arranging said M attributes in N groups corresponding to each of said N grouped sound source signals so as to form N grouped attributes;

memory means for storing said N grouped sound source signals;

reproducing means for reading out said N grouped sound source signals;

means for providing a control signal having one of position information and movement information; and a signal processor for performing virtual localization processing on the read-out N grouped sound source signals based on the control signal and the N grouped attributes so as to produce left and right stereo signals.

18. The apparatus for processing an audio signal according to claim 17, wherein said localization processing of said signal processor is a virtual sound image localization for obtaining the left and right stereo signals supplied to a pair of acoustic transducers to localize a sound image at an arbitrary position around a listener.

* * * * *